US012390014B1

(12) United States Patent
Rodriguez

(10) Patent No.: US 12,390,014 B1
(45) Date of Patent: Aug. 19, 2025

(54) CONVERTIBLE SUPPORT ASSEMBLY

(71) Applicant: Martin J. Rodriguez, Miami, FL (US)

(72) Inventor: Martin J. Rodriguez, Miami, FL (US)

( * ) Notice: Subject to any disclaimer, the term of this patent is extended or adjusted under 35 U.S.C. 154(b) by 210 days.

(21) Appl. No.: 18/221,743

(22) Filed: Jul. 13, 2023

Related U.S. Application Data

(63) Continuation-in-part of application No. 17/526,887, filed on Nov. 15, 2021, now Pat. No. 11,700,947.

(60) Provisional application No. 63/113,226, filed on Nov. 13, 2020.

(51) Int. Cl.
*A47C 13/00* (2006.01)

(52) U.S. Cl.
CPC ..... *A47C 13/00* (2013.01)

(58) Field of Classification Search
CPC ..... A47C 13/00; A47B 85/04; A47B 2220/07
See application file for complete search history.

(56) References Cited

U.S. PATENT DOCUMENTS

| | | | | |
|---|---|---|---|---|
| 2,705,994 | A * | 4/1955 | Stattler | A47C 7/407 297/410 |
| 3,004,792 | A * | 10/1961 | Bell | A47C 7/407 297/118 |
| 3,910,630 | A | 10/1975 | Runyon et al. | |
| 4,248,476 | A | 2/1981 | Phelps | |
| 4,382,627 | A | 5/1983 | Dean | |
| 5,098,153 | A | 3/1992 | Antoine | |
| 5,647,632 | A | 7/1997 | Fireman | |
| 7,207,624 | B2 | 4/2007 | Hoffman et al. | |
| 7,681,945 | B1 | 3/2010 | Wiecek et al. | |
| 11,439,242 | B1 | 9/2022 | Norton | |
| 11,439,243 | B2 * | 9/2022 | Norton | A47B 85/04 |
| 11,700,947 | B1 | 7/2023 | Rodriguez | |
| 2005/0253424 | A1 | 11/2005 | Thomas et al. | |
| 2014/0239680 | A1 | 8/2014 | Short | |
| 2016/0051047 | A1 | 2/2016 | Natuzzi | |
| 2020/0107642 | A1 | 4/2020 | Weldon et al. | |
| 2020/0237103 | A1 | 7/2020 | Norton | |
| 2021/0112968 | A1 | 4/2021 | Ponomar et al. | |
| 2022/0176190 | A1 | 6/2022 | Pena et al. | |

* cited by examiner

*Primary Examiner* — Shin H Kim
(74) *Attorney, Agent, or Firm* — MALLOY & MALLOY, PL

(57) ABSTRACT

A support assembly for an individual convertible into a plurality of different supportive orientations, including a base having opposed front and rear segments and a leg structure connected thereto. The base is selectively disposable in a chair configuration along the front segment or a bench configuration along the rear segment. The support assembly includes structural and operative features which facilitate support thereof in the chair configuration or the bench configuration by at least the base, the arm structure and outer ends of the leg structure being movably and/or relatively positioned to engage a support surface in supporting relation to the support assembly, dependent on its orientation in either the chair or bench configuration.

20 Claims, 24 Drawing Sheets

Fig. 7A
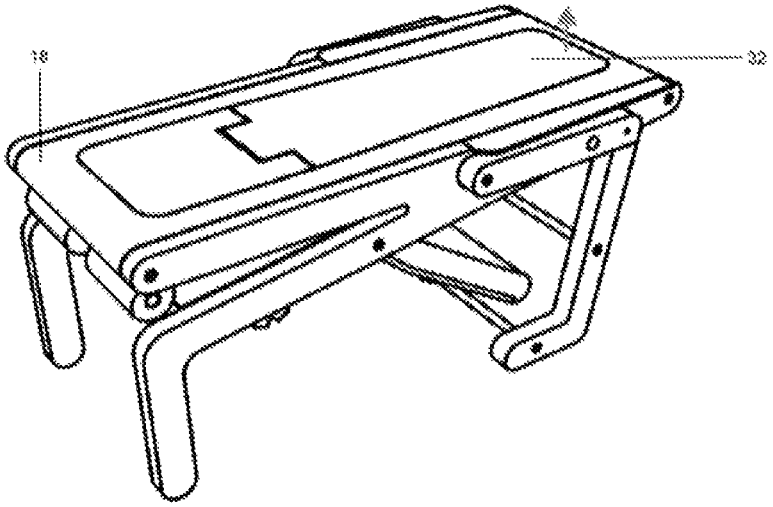
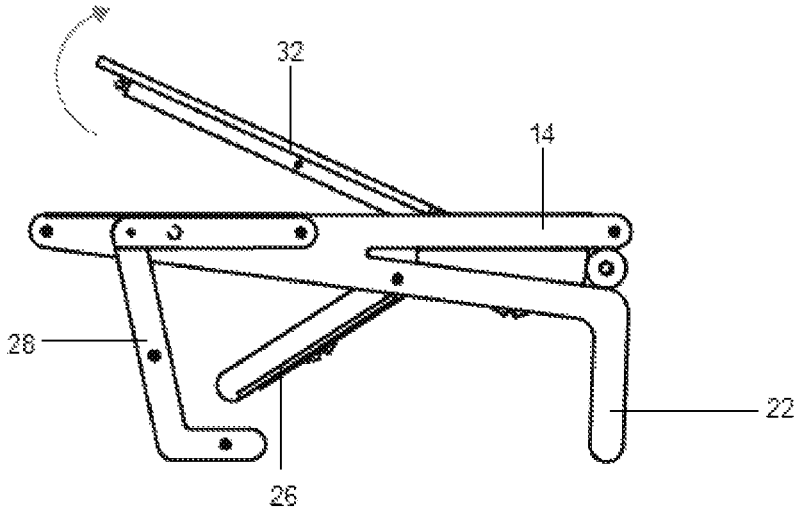
Fig. 7B

Fig. 7C
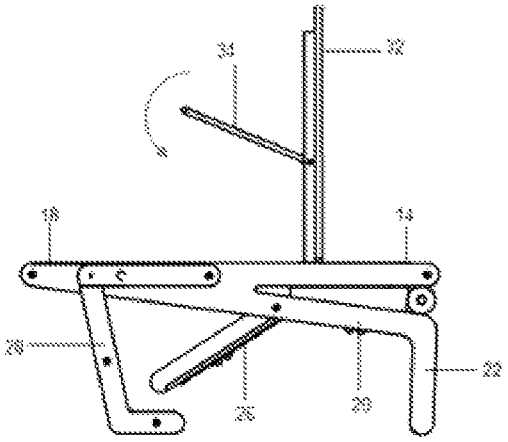
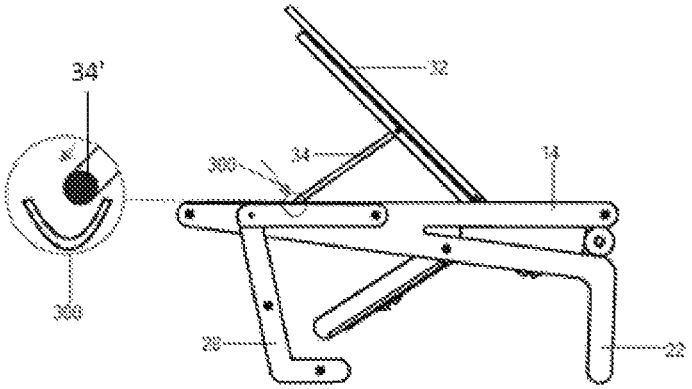
Fig. 7D

Fig. 13
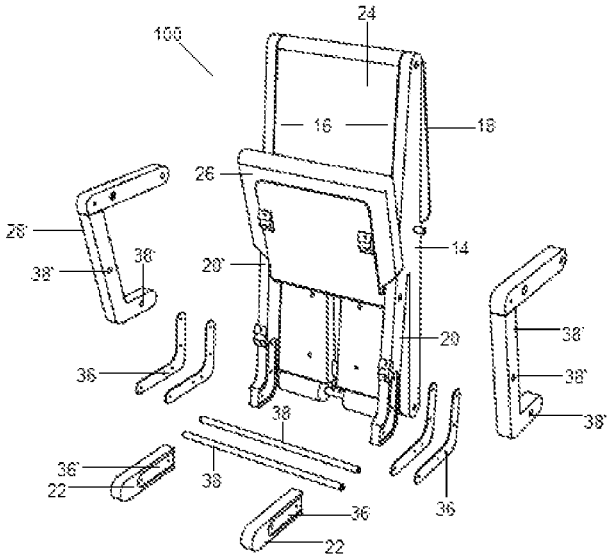
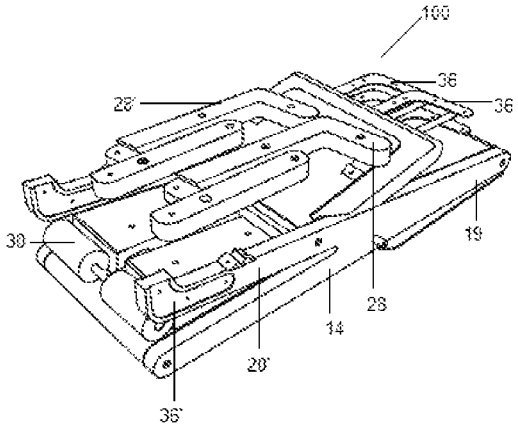
Fig. 14

CONVERTIBLE SUPPORT ASSEMBLY

CLAIM OF PRIORITY

This present application is based on and a claim of priority is made under 35 U.S.C. Section 119(e) to a provisional patent application that is in the U.S. Patent and Trademark Office, namely, that having Ser. No. 63/113,226 and a filing date of Nov. 13, 2020, as well as to another currently allowed and prior filed Non-Provisional application, namely, that having Ser. No. 17/526,887 filed on Nov. 15, 2021, the contents of which are both incorporated herein by reference in their entireties.

FIELD OF THE INVENTION

A support assembly for an individual, selectively disposable in at least first and second supportive orientations. The first supportive orientation comprises components of the support assembly interconnected to one another to define a chair configuration and the second supportive orientation comprises the components interconnected to one another to define a bench configuration.

DESCRIPTION OF THE RELATED ART

Recent events including, but not limited to, events relating to a pandemic environment have stressed the importance of being able to work from home instead of working from a commercial office or other area independent of the home. Unfortunately, many people don't have the luxury of having a spare workout room or a designated workout area in their home or place of residence. Limitations of this type prevent individuals from being able to properly exercise and/or purchase or otherwise procure proper workout equipment. This is due, at least in part, because of typically restricted space in the home, wherein most spaces or areas are designated for other purposes or events. This becomes even more evident when it is desired to practice or perform more strenuous exercise procedures including, but not limited to weightlifting. This is due in large part to the fact that weight lifting entails not only the use of free weights or "dumbbells" but also requires a workout bench. The majority of such structures which are readily available are not easily broken down into a collapsed orientation for storage or reconfigured to accommodate the exercise being performed.

Moreover, support assemblies, particularly of the type which facilitates weightlifting workouts, frequently require a workout bench to be changed into multiple positions such as a horizontal position, a substantially horizontal reclined position and an angularly disposed inclined position. While workout benches of the type referred to are commercially available and also available to individuals in gyms, or other commercial workout facilities, they still have the noted advantage of taking up a comparatively large amount of space and also include the structural and operative disadvantages relating to being broken down to facilitate storage in a reduced volume or area.

The aforementioned recent events, such as those relating to a pandemic environment, have also forced working individuals to have a dedicated "work from home" area. Such work areas also commonly require the use of a desk and a cooperatively structured, sized and/or configured chair.

Therefore, there is a need in current times for a support assembly capable of supporting an individual in a variety of different supportive orientations specifically including a chair capable of being used in a conventional work at home environment and having sufficient structural and operative versatility to be converted into a workout bench of the type set forth above, which includes the ability to be reconfigured to accommodate a variety of different workout techniques including, but not limited to weightlifting.

Such an improved and proposed support assembly should be designed with both health and ergonomics in mind. This can be accomplished by combining a workout bench with a chair into a single support assembly, while avoiding the sacrifice of functionality and/or comfort. In more specific terms, a chair configuration of such an improved and proposed support assembly should be sufficiently comfortable to allow an individual to occupy it in a conventional seated position for an entire workday. Further, when in a chair configuration or a workout bench configuration, sturdiness or a "professional feel" should not be compromised. Additional features which would overcome noted disadvantages in prior art or commercially available support assemblies should include easy assembly for use and equally easy and efficient breakdown for storage in a reduced volume or area.

Such a preferred and proposed support assembly should also be formed of reliable, sturdy, comparatively high-strength material, while at the same time incorporating components which are designed and structured to facilitate comfortable use in either of a possible two supportive orientations respectively and independently defining the aforementioned chair configuration and workout bench configuration.

SUMMARY OF THE INVENTION

The present invention is directed to an assembly for supporting an individual in a plurality of different orientations including, but not necessarily limited to, a first supportive orientation and a second supportive orientation. Further, the support assembly includes an elongated base having a front segment and a rear segment which are oppositely disposed on opposing sides of the base. The first supportive orientation comprises the front segment disposed in a chair configuration and the second supportive orientation comprises the rear segment disposed in a bench configuration. Accordingly, as set forth in greater detail hereinafter, the structural and operative versatility of the one or more embodiments of the present invention facilitates the selective conversion between the chair configuration and the bench configuration.

The chair configuration comprises a backrest, a seat and an armrest structure movably and collectively connected to one another to define a substantially upright position of the support assembly when in the chair configuration. Moreover, the armrest structure comprises a pair of armrests disposed in spaced relation to one another, wherein each of the pair of armrests is disposed in an arm supporting position, relative to the arms of a seated individual or occupant. In cooperation therewith, the seat and the backrest will be disposed in substantially conventional supporting relation to the correspondingly positioned body parts of the seated individual or occupant.

The support assembly further comprises an elongated leg structure which may be integrally or otherwise fixedly connected to the base. The elongated leg structure includes one outer or free end extending transversely outward from the remainder of the leg structure and from the front segment concurrent to disposition in of the assembly in the chair configuration. Moreover, support for the chair configuration comprises the one outer or free end of the leg structure and a correspondingly positioned end of the base being concurrently disposed in engaging relation to a supporting surface. As such, the disposition of at least a majority of the length of the one end of the leg structure is accomplished by a spaced, separated relation of the elongated leg from the remainder of the base along an entirety or at least a majority of the length of the elongated leg structure. As such the one end of the leg structure is also disposed in outwardly spaced relation to the base. Further, in one or more embodiments the leg structure comprises two spaced apart legs disposed on different longitudinal sides of the base and extending in spaced, separated relation from base along with an outer end of each of the legs.

The alternate or second supportive orientation defining the bench configuration of the assembly, comprises the rear segment of the base disposed in an outwardly or upwardly exposed, reclined position, concurrently to the front segment being disposed in a downwardly, substantially nonexposed position. The nonexposed position of the front segment comprising it facing downwardly, towards the support surface on which the bench configuration of the support assembly is disposed. The aforementioned reclined position may be accurately defined and disclosed as a substantially horizontal or alternatively angularly inclined orientation which facilitates the support of an individual or occupant on the exposed surface of the rear segment. When in the substantially horizontal, inclined position, the bench configuration is supported by the outer end of the leg structure and outer extremities of the armrests being concurrently disposed in engaging relation to a supporting surface. Alternately, when the rear segment is disposed in an angularly inclined position, support therefore comprises an outer extremity of the outer end of the leg structure and a majority of the length of the armrest structure concurrently engaging the supporting surface.

Therefore, the versatility of the support assembly includes structural and operative features which facilitate support thereof in the chair configuration and the bench configuration by at least the base, the arm structure and outer ends of the leg structure being movably and/or relatively positioned so as to engage a supporting surface in supporting relation to the support assembly when in the first and second supportive orientations. By way of example, the armrest structure is movably connected to the base and selectively positioned between the aforementioned arm supporting position relative to a seated individual or occupant, when in the chair configuration and alternatively into engagement with a supporting surface and supporting relation to the base concurrent to the support assembly being disposed in the bench configuration.

Additional structural and operative features of support assembly, when in the bench configuration, include the rear segment comprising a back support movably connected to the base and to the rear segment and being alternatively disposable in a collapsed position and/or an outwardly extended position concurrent to the support assembly being in the bench configuration. Moreover, when the back support extends outwardly from the base and/or rear segment it may be disposed in a transverse, substantially perpendicular relation to the rear segment or alternatively in one of the pluralities of transverse orientations having an angular disposition of less than 90° such as, but not limited to 30°, 45° etc. relative to the remainder of the rear segment. However, when the back support is in the collapsed position it is preferably disposed in aligned, substantially coplanar relation to the rear segment and in at least one embodiment may be inserted partially in an appropriate recessed or open area formed in the rear segment.

Also, when the back support is in the outwardly extending position, a back-support arm is movably connected to a remainder of the back support and positioned outwardly therefrom, such that the outer and/or extremity thereof is removably disposed in engaging relation with a length of the base and/or a length of a correspondingly disposed portion of the rear segment of the base.

Yet additional structural and operative features of the support assembly of the present invention comprises at least some of the aforementioned components such as, but not limited to, the armrest structure and portions of the elongated leg structure being removably or detachably connected to remainder of the support assembly to facilitate packing, storage, shipping, etc. More specifically, when so detached the various components of the support assembly may be collectively arranged to assume a smaller volume or area and then be easily reassembled when ready for use.

As will be explained in greater detail hereinafter, the movable, repositioning of the various components of the support assembly may be easily and quickly accomplished when the support assembly is being selectively disposed between the chair configuration and the bench configuration. Similarly, when in the bench configuration, adjustment and relative connected disposition of at least some of the components of the support assembly may be efficiently accomplished when it is desired to dispose the bench configuration in the aforementioned angularly reclined position and/or adjust the back support into its various angular orientations.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIGS. 7A-7E collectively and successively demonstrate adjustable positioning of the various components of the support assembly to accomplish an outwardly extending positioning of a back support associated with the bench configuration of FIG. 1B.

FIG. 13 is a perspective view in at least partially exploded form of one embodiment of the support assembly of the present invention in at least a partially a disassembled mode.

FIG. 14 is a perspective view of a collection of the components of one embodiment of the support assembly of the present invention in a reduced volume configuration.

Like reference numerals refer to like parts throughout the several views of the drawings.

DETAILED DESCRIPTION OF THE PREFERRED EMBODIMENT

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1A:
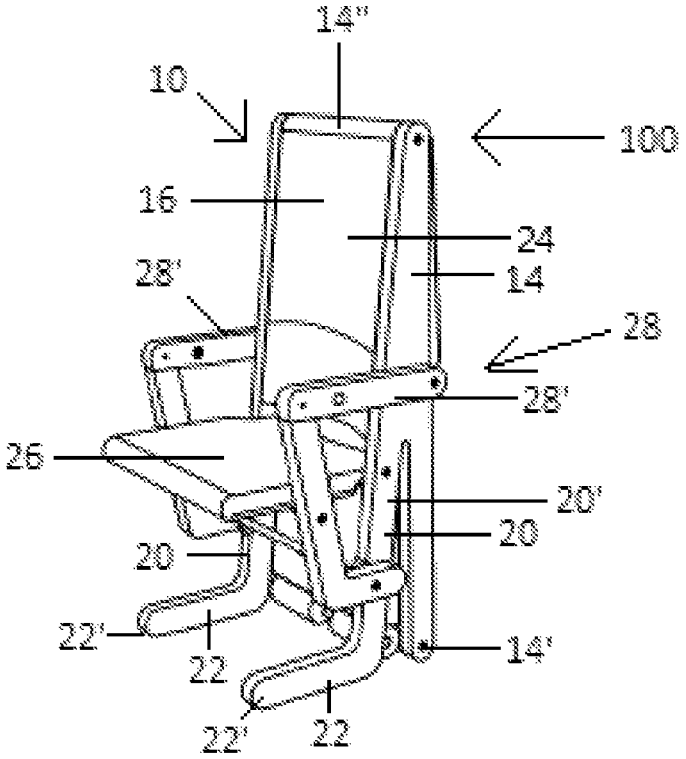
FIG. 1A is a perspective view of one embodiment of the support assembly of the present invention in a chair configuration.
Figure 1B:
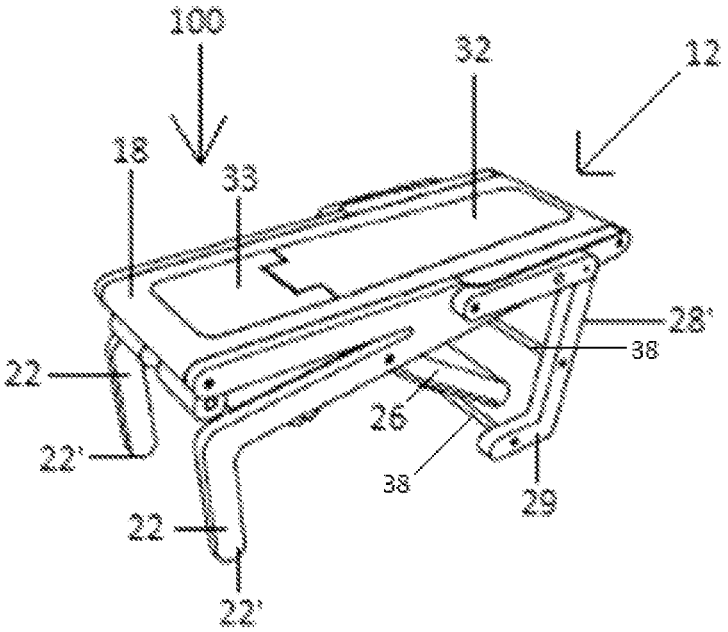
FIG. 1B is a perspective view of the embodiment of the support assembly, as represented in FIG. 1A, in a bench configuration.

As represented in FIGS. 1A and 1B, the present invention is directed to a support assembly generally indicated as 100 respectively disposed in a first supportive orientation at least partially defined by a chair configuration 10 and a second supportive orientation at least partially defined by a bench orientation 12, each of the chair configuration 10 and the bench configuration 12 is operatively disposed on a supporting surface 200.

The support assembly 100, regardless of its selective disposition in either the chair configuration 10 or the bench configuration 12 comprises an elongated base 14 comprising a front segment 16 and a rear segment 18 being disposed on opposite sides of the base 14 in opposed relation to one another. In addition, the base 14 includes an elongated leg 20 preferably but not necessarily fixedly or integrally secured to the base 14 in outwardly spaced, separated relation thereto. The elongated leg structure 20 includes an outer or free end 22 extending transversely outward from the remainder of the length of the elongated leg structure 20. As represented, the leg structure 20 includes a pair of spaced apart legs 20' extending along or defining opposite longitudinal sides of the base 14, wherein each of the legs 20' include the one free or outer end 22.

The chair configuration 10 comprises a backrest 24, a seat 26 and an armrest structure 28 movably and collectively connected to one another to define a substantially upright position of the support assembly 100 when in the chair configuration 10, as represented in at least FIG. 1A. Moreover, the armrest structure 28 comprises a pair of armrests 28' disposed in spaced relation to one another, wherein each of the pair of armrests 28', when in the chair configuration 10, are disposed in an arm supporting position, relative to the arms of a seated individual (not shown for purposes of clarity). In cooperation therewith, the seat 26 and the backrest 24 will be cooperatively disposed in a substantially conventional supporting position relative to one another and to a seated individual, so as to adequately support corresponding body parts of the seated individual.

The support assembly 100 further comprises the aforementioned elongated leg structure 20 which may be connected to the base and includes one outer or free end 22 extending transversely outward from the remainder of the leg structure 20 and from the front segment 16 concurrent to disposition in of the assembly 100 in the chair configuration 10. Moreover, support for the chair configuration 10 comprises the one outer or free end 22 of each of the pair of legs 20' as well as a correspondingly positioned end 14' of the base 14 being concurrently disposed in engaging relation to the supporting surface 200. As such, the disposition of at least a majority of the length of the one end of each of the pair of support legs 20' is accomplished by the spaced, separated relation of the elongated leg structure 20 from the remainder of the base 14 along an entirety or at least a majority of the length of the elongated leg structure 20, including both of the elongated legs 20'. As such, the one end 22 of each of the elongated legs 20' are also disposed in outwardly spaced relation to the base 14. Further, in one or more embodiments the leg structure 20, including the two spaced apart legs 20' extend in spaced, separated relation from base 14 to define what may be accurately described as a bifurcated construction.

As set forth above, the alternate or second supportive orientation is at least partially defined by the bench configuration 12, wherein the rear segment 18 of the base 14 is disposed in an outwardly or upwardly exposed, reclined position, as represented in at least FIG. 1B. Such an outwardly or upwardly exposed reclined position is concurrent to the front segment 16 being disposed in a downwardly, substantially nonexposed position, by virtue of it facing the support surface 200 on which the bench configuration 18 of the support assembly 100 is disposed. The aforementioned reclined position of the bench configuration 12 may be accurately defined and disclosed as a substantially horizontal orientation, as represented in at least FIG. 1B or alternatively an angularly inclined orientation, as represented in at least FIG. 3. Both of the substantially horizontally reclined positions of FIG. 1B and the angularly inclined position of the bench configuration 12, as represented in at least FIG. 3, facilitate the support of an individual on the exposed surface of the rear segment 18.

Figure 3:
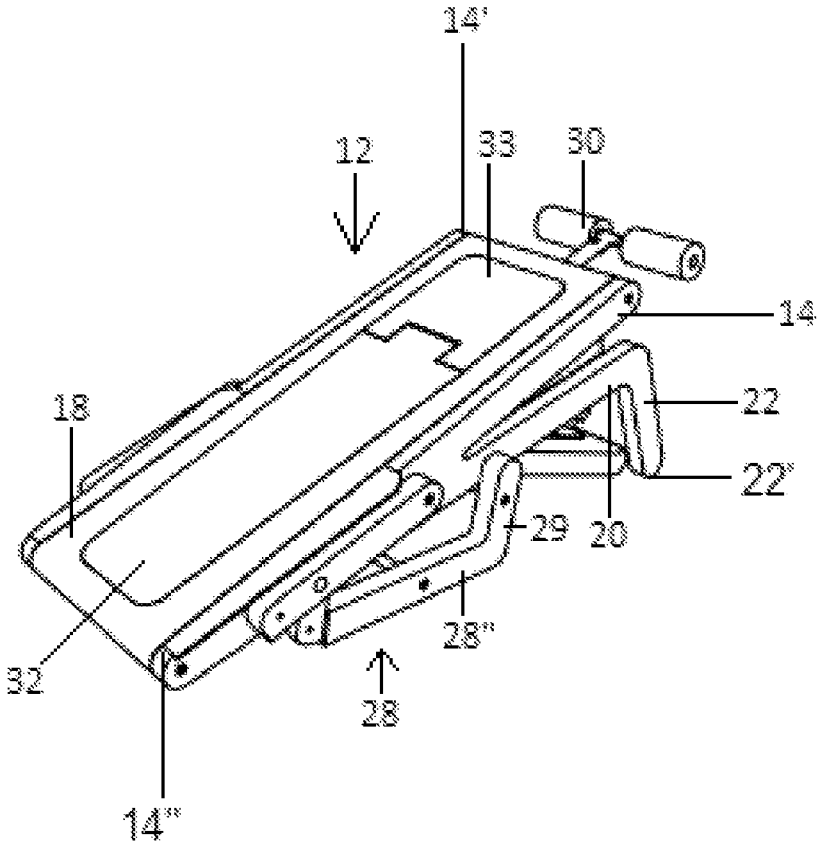
FIG. 3 is a perspective view of the bench configuration of FIG. 1B in an angularly inclined position.

As also represented in at least FIG. 1B, when in the substantially horizontal, inclined position, the bench configuration 12 is supported by the outermost extremity 22' of the outer end 22 of each of the legs 20' of the leg structure 20, and concurrently with the outer extremities or ends 29 of both the armrests 28' of the arm rest structure 28. Alternately, when the rear segment 18 is disposed in an angularly inclined position as represented in at least FIG. 3, support therefore comprises concurrent engagement with the support surface 200 of an outer extremity 22' of the outer end 22 of each of the support legs 20' and at least a majority of the length, as at 28", of each of the armrests 28' of the armrest structure 28. As also represented in FIG. 3 one end of the base 14, as at 14" may also be disposed in supporting engagement with the support surface 200, when the bench configuration 12 is in the inclined orientation. In at least one alternate embodiment, the end 14" may remain spaced above the support surface 200.

Figure 4A:
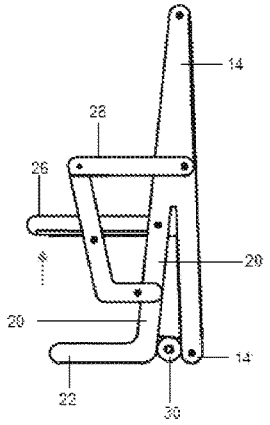
FIGS. 4A-4C; 5A-5B and 6A-6B are side views representing adjustable repositioning of the various components of one embodiment of the support assembly from the chair configuration of FIG. 1A to the bench configuration of FIG. 1B.
Figure 4B:
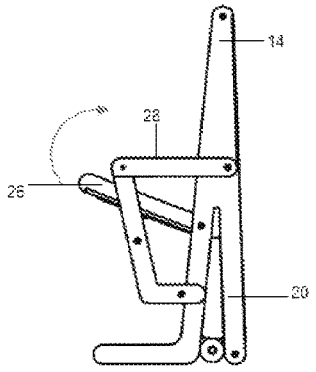
Figure 4C:
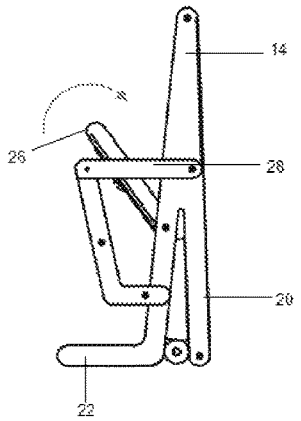

Also demonstrated throughout the Figures and as clearly represented in FIG. 3, a foot extension 30 may extend longitudinally outward from the end of 14' of the base 14 in support of an individual's feet, when the individual is supported on the inclined or reclined bench configuration 12. However, when selectively disposed in a stored orientation, as represented in FIGS. 4A-4C, the foot extension 30 may be retracted and disposed in the spacing between the leg structure 20 and the correspondingly positioned portion or length of the frame 14.

Therefore, the versatility of the support assembly 100 includes structural and operative features which facilitate support thereof in the chair configuration 10 and the bench configuration 12 by different portions of at least the base 14, the armrest structure 28 and outer ends 22 of the leg structure 20 being movably, removably and/or relatively positioned so as to engage a supporting surface 200. By way of example, the armrest structure 28 is movably connected to the base 14 and selectively positioned in the aforementioned arm supporting position relative to a seated individual, when in the chair configuration of FIG. 1B. Alternatively, the armrest structure 28 is disposed into engagement with the supporting surface 200 and supporting relation to the base 14 concurrent to the support assembly 100 being disposed in the bench configuration 12.

Figure 2A:
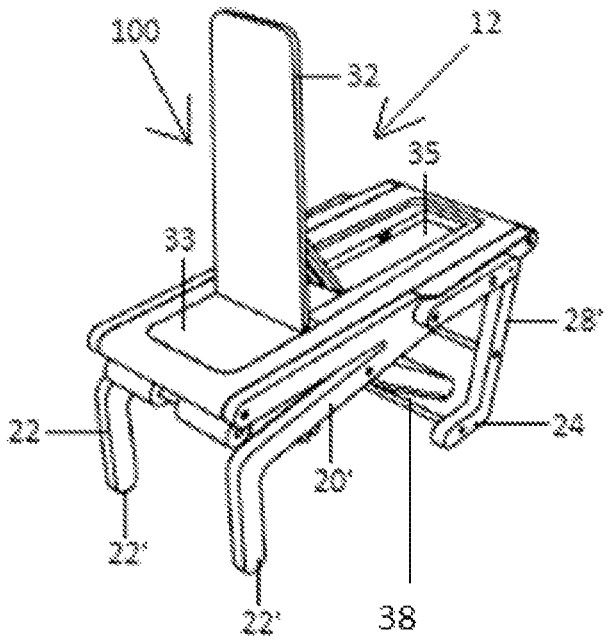
FIG. 2A is a perspective view of the present invention in a bench configuration with an outwardly extended back support.
Figure 2B:
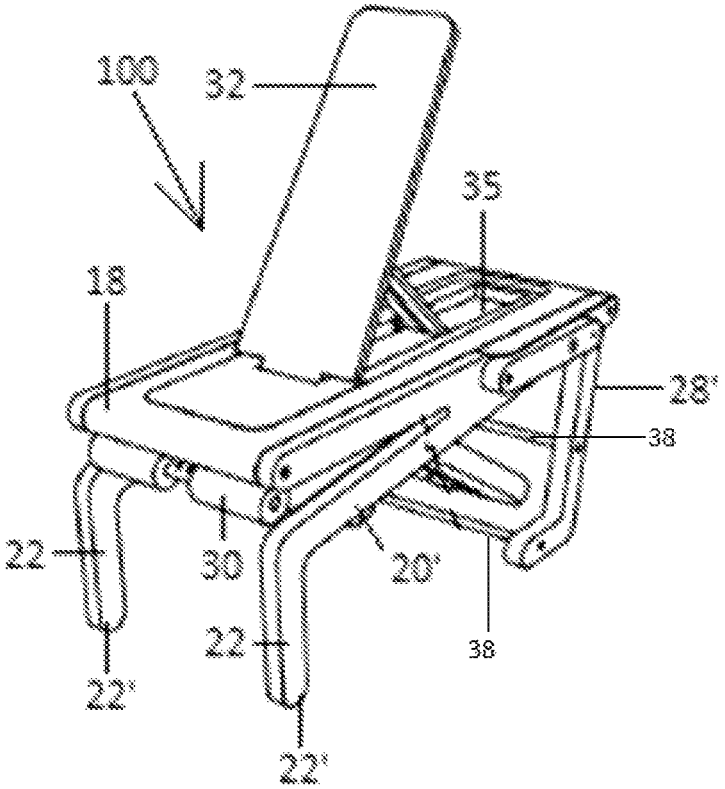
FIG. 2B is a perspective view similar to the embodiment of FIG. 2A in a different angular supportive position.

Additional structural and operative features of support assembly 100, as represented in at least FIG. 3, include the rear segment 18 comprising a back support 32 and an adjacent support segment 33, wherein the back support 32 is movably connected to the base 14 and to the rear segment 18. As such the back support 32 is alternatively disposable in a collapsed position as represented in at least FIG. 1B and/or in an outwardly extended position, as represented in FIGS. 2A, 2B and 3, concurrent to the support assembly 100 being in the bench configuration. Moreover, when the back support 32 extends outwardly from the base 14 and/or rear segment 18, it may be disposed in a transverse, substantially perpendicular relation to the rear segment 18, as in at least FIG. 2A. Alternatively, the back support 24 may be disposed in one of a plurality of different angular transverse orientations as represented in at least FIG. 2B. As such, the angular disposition of the back support 32 may be less than 90° such as, but not limited to 30°, 45° etc. relative to the base 14 and remainder of the rear segment 18. However, when the back support 32 is in the collapsed position of at least FIG. 1B, it is preferably disposed in aligned, substantially coplanar relation to the rear segment 18 and in at least one embodiment may be at least partially inserted in an appropriate recess or open area 35, formed in the rear segment 18.

Also, when the back support 32 is in the outwardly extended position, a back support arm 34 (see FIGS. 7D-7E) is movably connected to a remainder of the back support (and/or to the base 14) and positioned outwardly therefrom, such that the outer end/or extremity 34' thereof is removably disposed in engaging relation with a length of the base 14 and/or a length of a correspondingly disposed portion of the rear segment 18.

Yet additional structural and operative features of the support assembly 100 as represented in FIGS. 13 and 14 comprise at least some of the aforementioned components such as, but not limited to, the armrest structure 28 and portions of the elongated leg structure 20, being removably or detachably connected to other portions or components of the support assembly 100 to facilitate packing, storage, shipping, etc. More specifically, when so detached the various components of the support assembly 100 may be collectively arranged to assume a smaller volume or area, as represented in FIG. 14 and then be easily reassembled into either of the chair configuration 10 or bench configuration 12, when ready for use.

In even more specific terms and with reference to FIGS. 13 and 14, the base 14 may be at least partially intact, wherein the backrest 24 and the seat 26 may remain connected to the base 14. The armrest structure 28 including the pair of armrests 28' may be detached as represented. Similarly, the outer ends 22 of each of the support legs 20' of the support leg structure 20 may be removably connected using connecting brackets 36. In cooperation therewith, portions of the elongated support legs 20' and the outer ends 22 may include recessed areas 36' for insertion and connection of the support/connecting brackets 36. Also, a plurality of at least two elongated braces or support rods may be secured to inner portions of the spaced apart armrests 28', as at 38'. When so assembled, the elongated braces or support rods 38 serve to support an under portion of the seat 26, when in the chair configuration 10 as represented in at least FIG. 1A as well as support and under portion of the base 14 on the pair of armrests 28', when in the inclined bench configuration 12 as represented in at least FIG. 3.

As will be explained in greater detail hereinafter, the movable, repositioning of the various components of the support assembly 100 may be easily and quickly accomplished when the support assembly 100 is being selectively disposed between the chair configuration 10 and the bench configuration 12. Similarly, when in the bench configuration 12, adjustment and relative connected disposition of at least some of the components of the support assembly 100 may be efficiently accomplished when it is desired to dispose the bench configuration 12 in the aforementioned angularly reclined position and/or adjust the back support 32 into its various angular orientations.

Figure 5A:
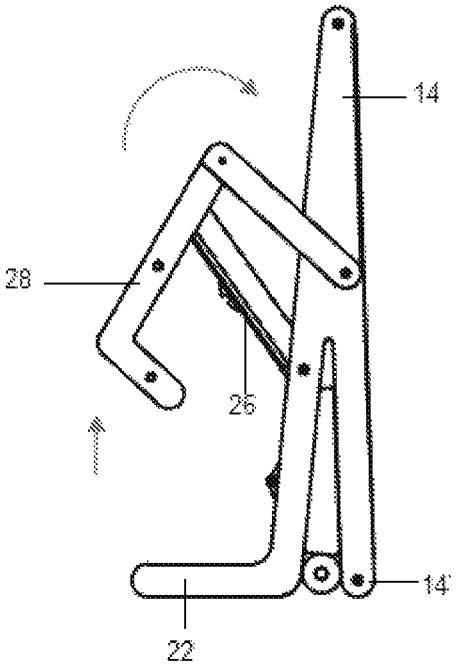
Figure 5B:
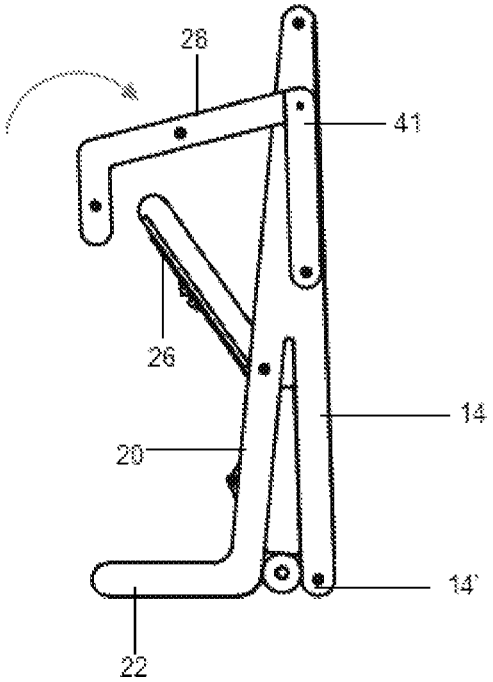
Figure 6A:
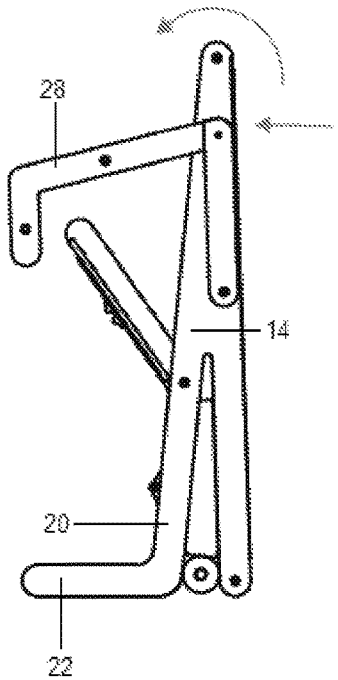
Figure 6B:
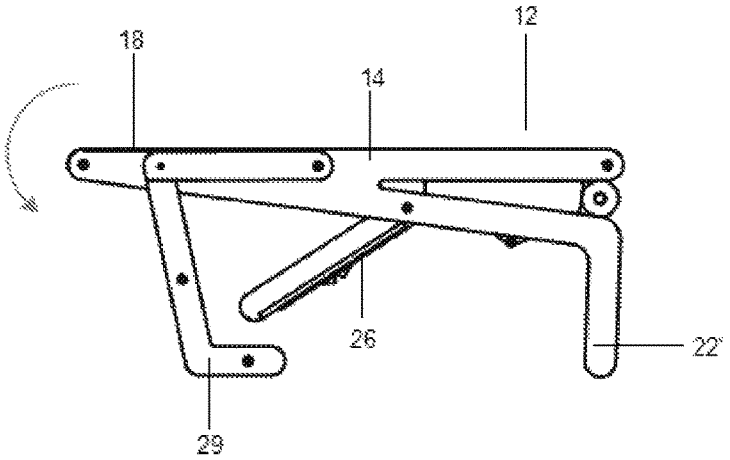

More specifically and with reference to FIGS. 4A-4C; 5A-5B and 6A-6B the chair configuration 10 may be readily disposed into the reclined, substantially horizontal bench configuration 12, as in FIG. 1A, by performing the following successive steps as further emphasized by the included directional arrows. The aforementioned successive steps include raising the seat 26 to a 45° angle as represented in FIGS. 4A-4C. Thereafter, raise the arm rest structure 28 including both of the armrests 28' so that the support rods 38 (see FIGS. 1B, 2A and 2B) as to clear, the seat 26 and secure the armrests 28' to the base, as represented in FIGS. 5A-5B. Subsequently, push the base 14 over into a substantially horizontal position, as represented in FIGS. 6A and 6B. In such a flat, substantially horizontal reclined orientation of the bench configuration 12 as clearly represented in FIG. 6B, the extremity 22' of the outer end 22 of the elongated support arm 20 will be disposed in engaging relation with a supporting surface 200. Concurrently the end 29 of each of the armrests 28' will be disposed in engaging relation with the supporting surface 200 and collectively the end 29 and the extremity 22' will provide proper support for the bench configuration in the flat, substantially horizontal, reclined position of the bench configuration 12.

Figure 7E:
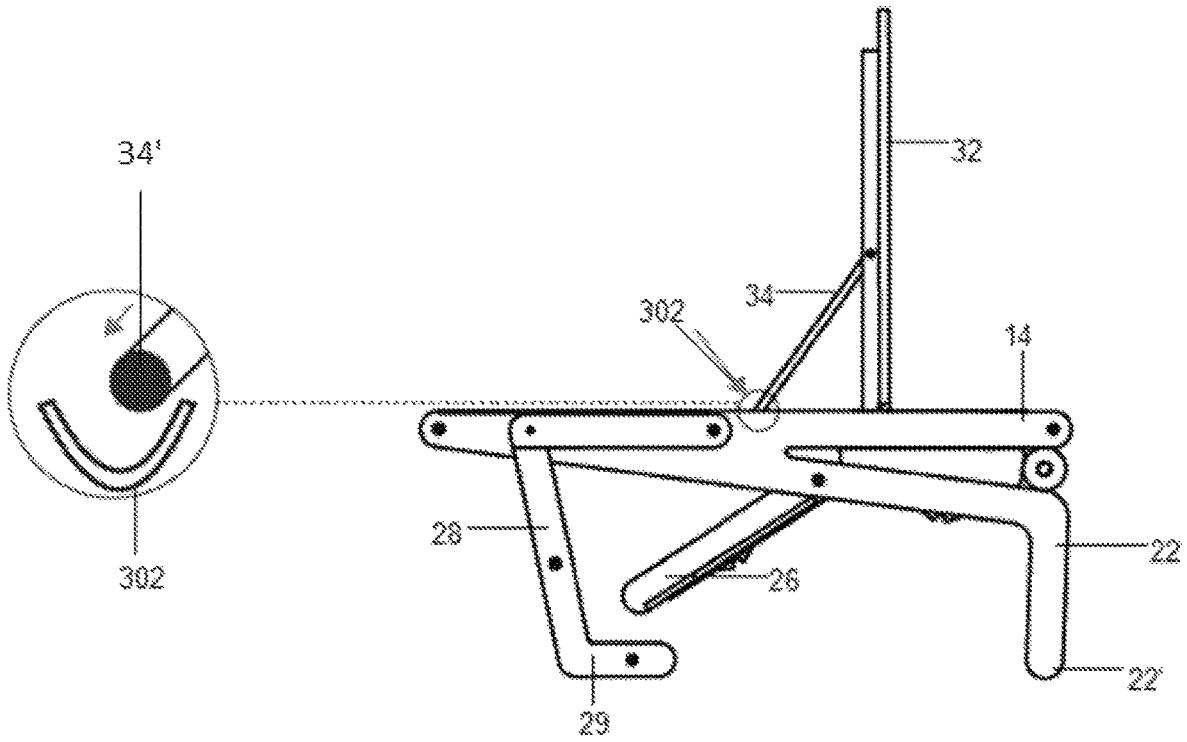

When the support assembly 100 is in the bench configuration 12, FIGS. 7A-7D will successively represent the procedures for orienting the back support 32 in an angular position of generally about 45°. The back support 32 is pulled to release it from the collapsed position relative to the rear segment 18. The back support 32 is lifted and the back support arm 34 is lowered as represented in FIGS. 7B and 7C. Thereafter the outer extremity of the backrest support arm 34 is secured to an appropriate length of the base 14 and/or rear segment 18 as represented in detail at 300. FIG. 7E represents the back support 34 being oriented relative to the base 14 and/or rear segment 18 in a substantially upright, perpendicular orientation. As such the same procedural steps are involved as represented in FIGS. 7A-7C. Thereafter, the back support arm 34 is removably disposed in engaging relation to a length of the base 14 and or rear segment 18 at a different location 302.

Figure 8A:
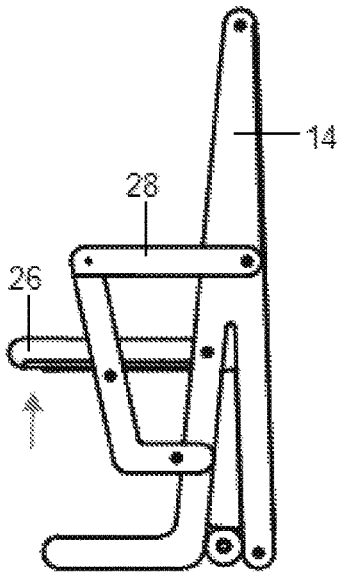
FIGS. 8A-8C; 9A-9B; 10A-10B; 11A-11C and 12A-12B successively demonstrate adjustable positioning of the various components of the support assembly to accomplish conversion from the chair configuration of FIG. 1A to an angularly inclined position of the bench configuration of the embodiment of FIG. 1B.
Figure 8B:
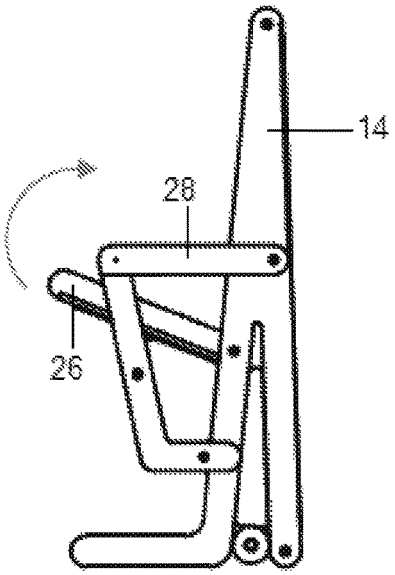
Figure 8C:
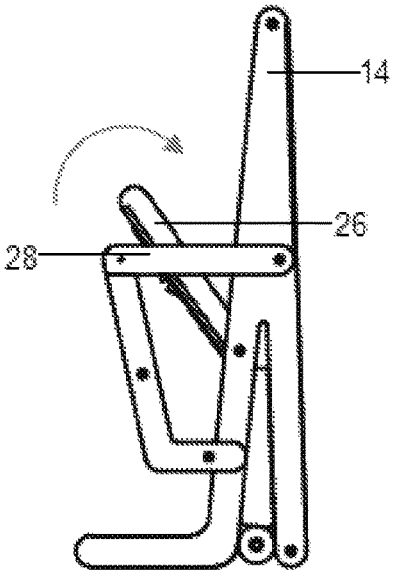
Figure 9A:
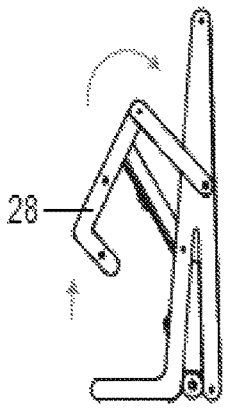
Figure 9B:
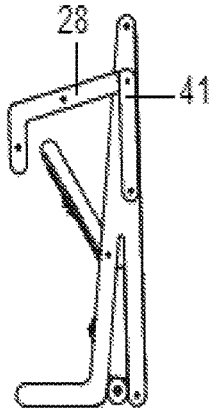
Figure 10A:
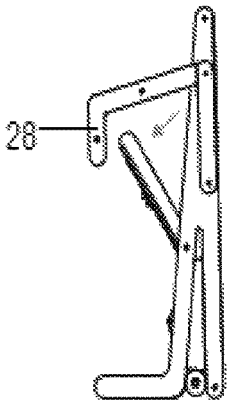
Figure 10B:
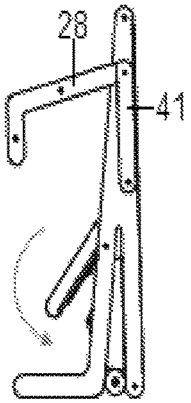
Figures 11A, 11B, 11C:
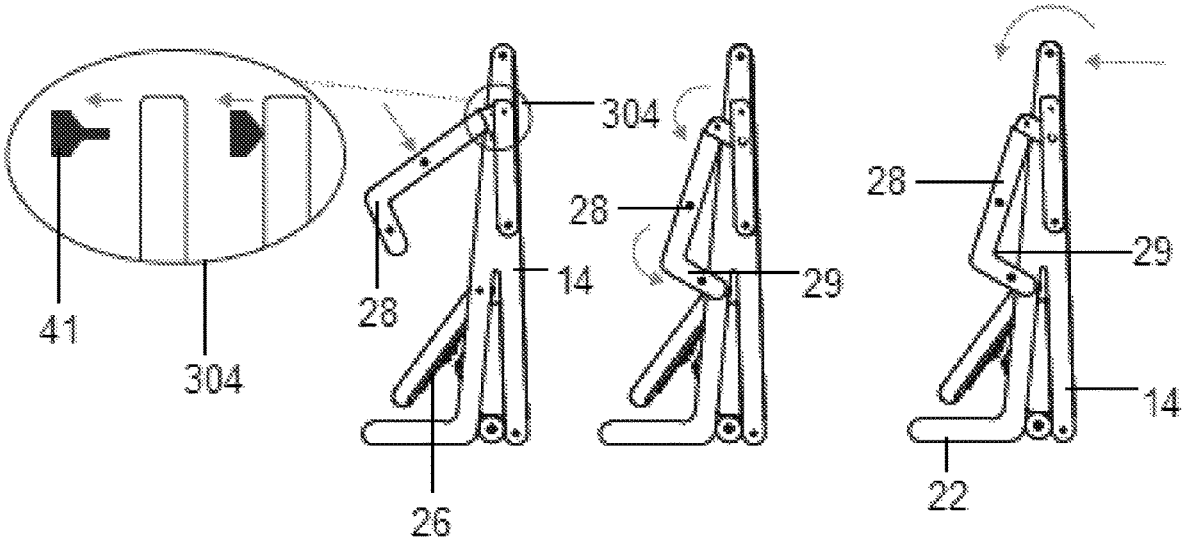
Figure 12A:
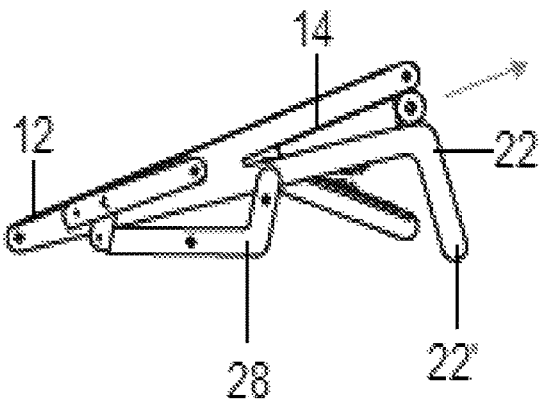
Figure 12B:
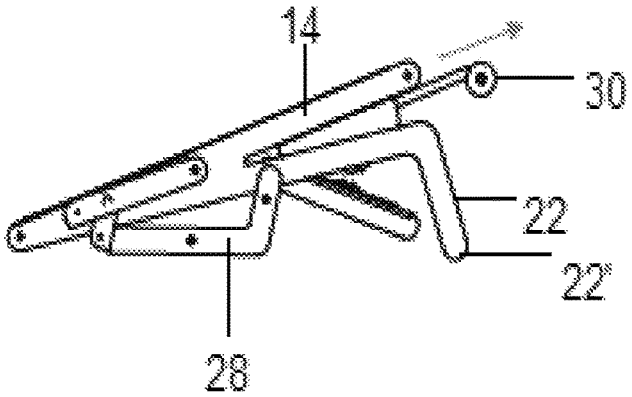

FIGS. 8A-8C; 9A-9B; 10A-10B; 11A-11C and 12A-12B successively represent the adjustable positioning of the various components of the support assembly 100 to accomplish the conversion thereof from the chair configuration 10 of FIG. 1A to an angularly inclined position of the bench configuration 12, as represented in FIG. 3. As represented in FIGS. 8A-8C, the seat 26 is raised in accordance with the directional arrows to an approximate 45° angle. Thereafter, as represented in FIGS. 9A-9B, and FIGS. 10A-10B, the armrests 28' are raised to facilitate the lowering of the seat 26 to an out-of-the-way location as represented in FIG. 10B. Thereafter, safety connectors 41 are released on both sides of the armrests 28' thereby allowing a lowering of the armrests 28' into the position represented in FIGS. 11B and 11C. The support assembly is the then pushed over into an inclined position as represented in FIGS. 12A-12B and the foot extension 30 is extended outwardly, if needed, for support of an individual's feet.

The support assembly of the present invention further comprises yet additional embodiments as represented in detail in FIGS. 15-23A. Moreover, the represented support assembly is generally indicated as 100' and is substantially equivalent in its structural and operative features, with the exception of those set forth in in detail hereinafter and represented in the indicated figures. Therefore, the support assembly 100' includes an elongated base 14, including an elongated leg structure 20 comprised of spaced apart support legs 20'. The base 14 further comprises a front segment 16 and a rear segment 18 disposed on opposite sides of the base 14. The base 14 is disposable in a first supportive orientation, wherein the front segment 16 is disposable in a chair configuration 10'. The chair configuration 10' includes a back rest 24 and a seat 26' as well as an armrest structure 28, including armrests 28' spaced from one another.

As represented respectively in greater detail in the embodiments of FIGS. 16A-16C and 17A-17C, the seat 26' may be in the form of a cushioned seat or other structure operatively similar to the seat 26 in the embodiments of FIGS. 1-14. The seat 26', as well as the armrest structure 28 are movable relative to one another and are adjustably disposed relative to the backrest 24 of the chair configuration 10'. In addition, the rear segment 18 is disposed in a bench configuration 12', wherein the bench configuration 12' is at least partially defined and represented as the elongated leg structure 20 and armrest structure 28, concurrently disposed in engaging relation to a supporting surface 200 of the bench configuration 12'.

Figure 16C:
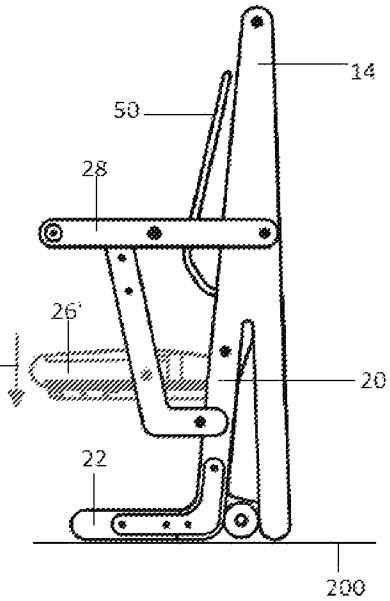
FIG. 16A-16C are side views of the embodiment of FIG. 15 representative of the successive steps of adjustment of a seat component.
Figure 16B:
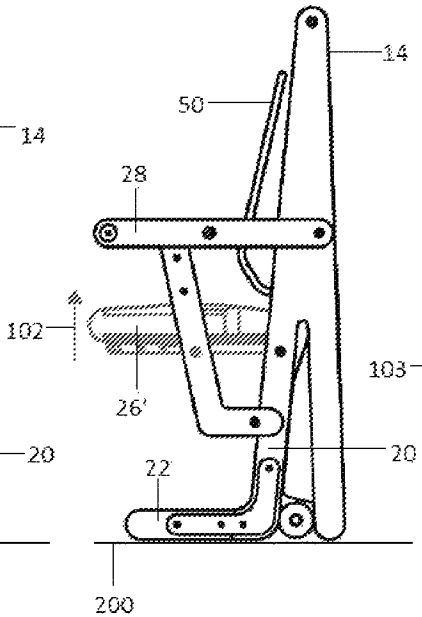
Figure 16A:
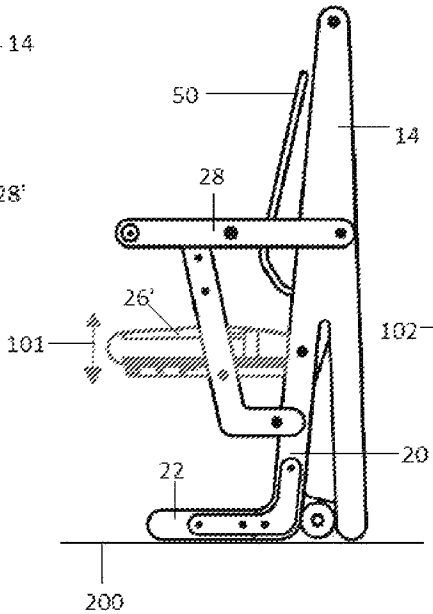
Figure 15:
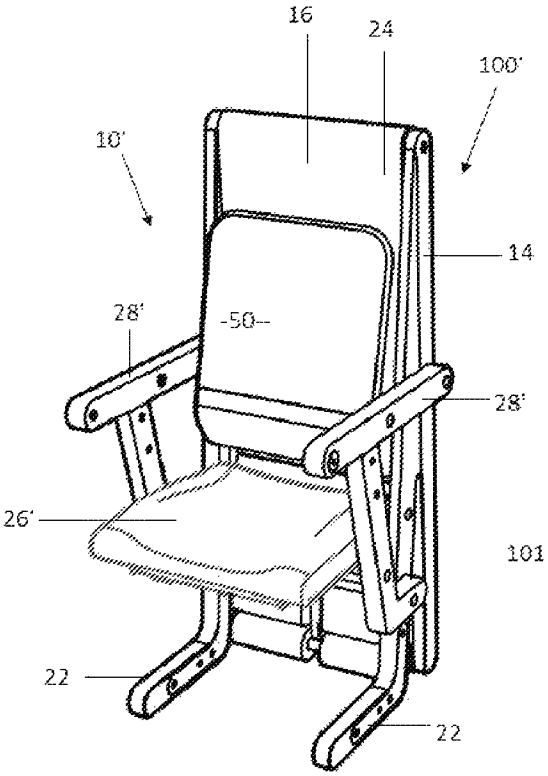
FIG. 15 is a front perspective view of yet another embodiment of the support assembly of the present invention in a chair configuration, incorporating adjustable components.

With primary reference to FIGS. 15-16C, the seat 26' is adjustably disposed along the length of the backrest 24 at different heights relative to the supporting surface 200, wherein such up, down, and reciprocal adjustability is schematically represented by directional arrows 101, 102 and 103. With primary reference to the embodiment of FIGS. 17A-17C, the armrest structure 28 including each of the armrests 28' is adjustably disposed along a length of said base 14 and the backrest 24, at different heights, relative to the supporting surface 200, as schematically represented by the directional arrows 101', 102' and 103'. It is a further note that the adjustable height of the armrest structure 28 may be accomplished independently of the adjustable position of the seat 26'. However, in more practical terms the relative heights of the seat 26' and the armrest structure 28, relative to the supporting surface 200 may be at least partially dependent on one another so as to accommodate a comfortable sitting orientation of an occupant, as well as the size of the occupant.

The movable and/or adjustable mounting, connection, support and/or disposition of both the seat 26' and the armrest structure 28 may vary by either or both being connected to the frame 14 in an appropriate manner and/or by either or both being mounted on or connected to the backrest 24 or the front segment 16. It is further recognized that at least partial support of the seat 26' as well as a possible intended substantially level or horizontal orientation thereof is facilitated by the seat 26' being at least partially supported on the support rods 38 (see at least FIGS. 1B, 2A, and 2B). This may further emphasize the concurrent adjustment of the relative heights of the seat 26' and armrest structure 28 to further facilitate at least partial support of the seat 26' by the one or more support rods 38.

Figures 17A, 17B, 17C:
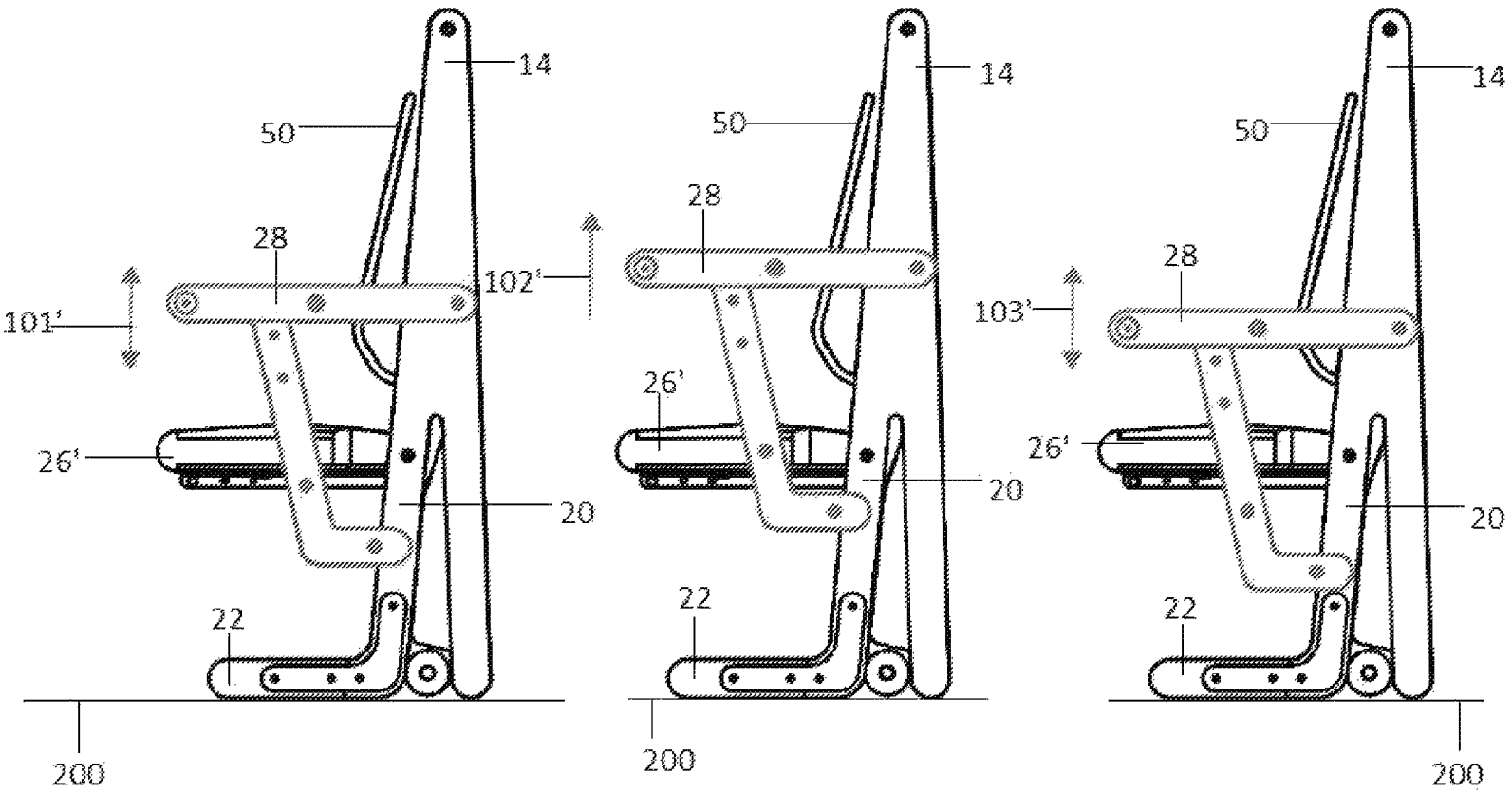
FIG. 17A-17C are side views of the embodiment of FIG. 15 representative of successive steps of adjustment of an armrest structure.
Figures 18A, 18B, 18C:
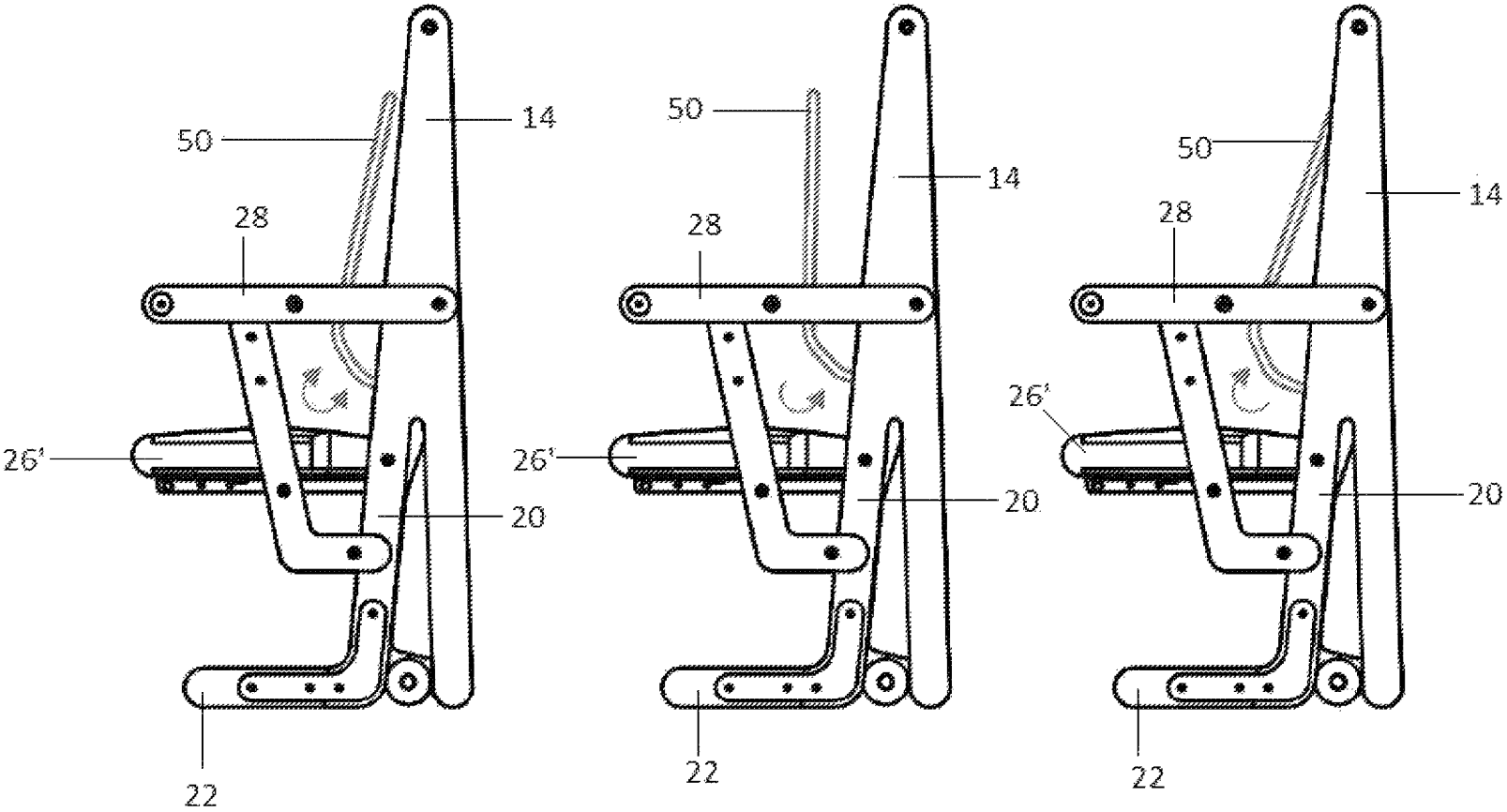
FIG. 18A-18C are side views of the embodiment of FIG. 15 representative of successive steps of adjustment of a support segment.

With primary reference to FIGS. 17A-17C yet additional structural and operative features of the support assembly 100', at least when assuming the chair configuration 10', is the inclusion of a support segment 50 movably and or adjustably disposed relative to the height or length of the backrest 24. In more specific terms, the support segment 50 is disposed in at least partially outwardly extending relation to the backrest 24 so as to engage and be disposed in the supportive engagement with a back portion, and/or preferably a lower back portion of an occupant of the chair configuration 10'. The movable and or adjustable disposition of the support segment 50 relative to the backrest 24 as well as the front segment 16 allows it to be selectively disposed along the length thereof in order for proper or desirable positioning to accomplish the aforementioned supportive engagement with the back portion of an occupant. It is of further note that the support segment 50 may be moved separately or independently of the seat 26' and/or armrest structure 28. However, in more practical terms the relative height or position of the support segment 50 relative to the supporting surface 200 may be at least partially dependent on the heights of the seat 26' and armrest structure 28 in order to accommodate the comfortable sitting orientation and/or size of an occupant. As with the seat 26' and the arm structure 28, the support segment 50 may be connected to, mounted on or supported by the frame 14 in an appropriate manner and/or by being mounted on or connected to the backrest 24 and/or the front segment 16.

Figures 19A, 19B, 19C:
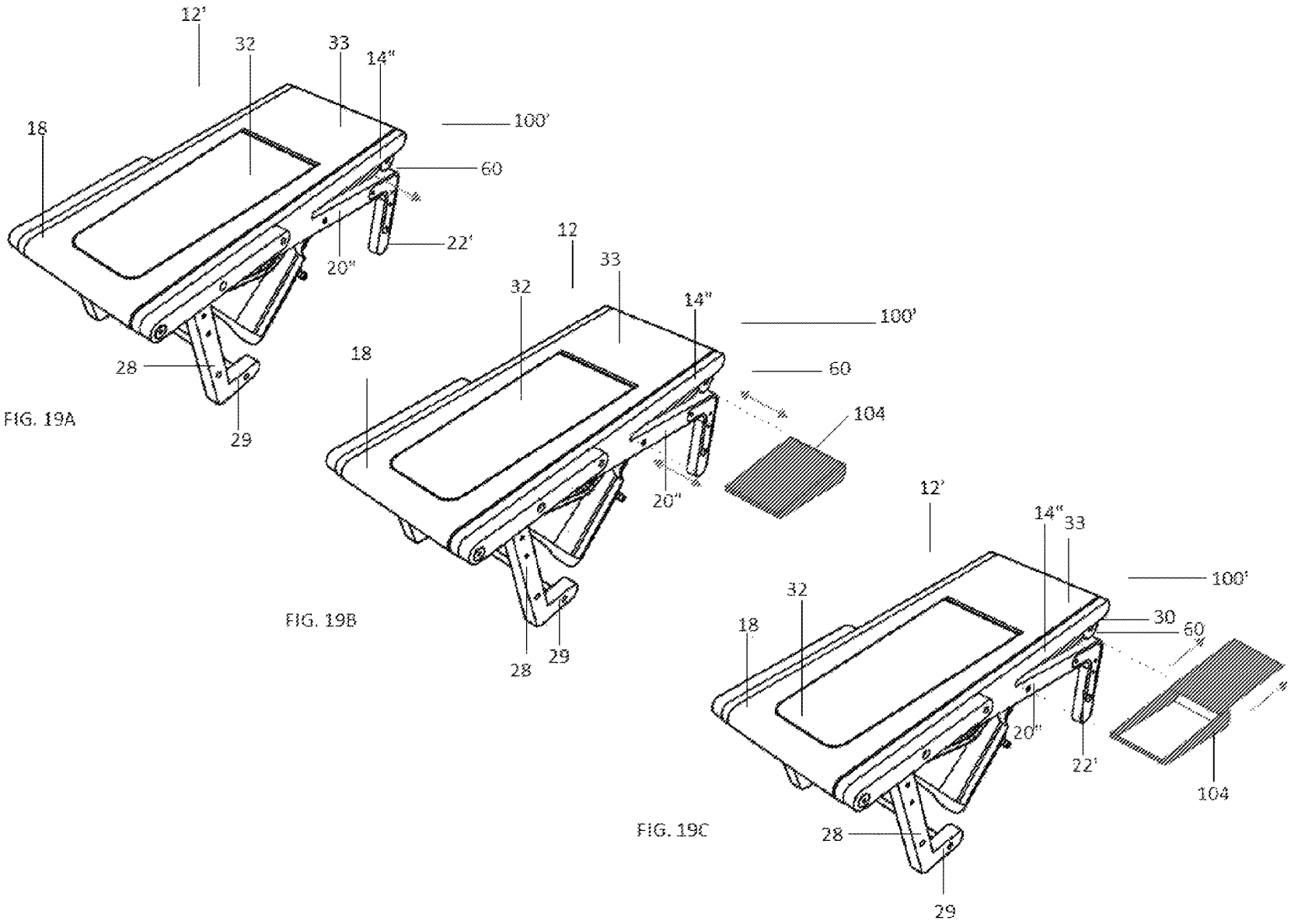
FIG. 19A-19C are perspective views of the support assembly of the embodiment of FIG. 15 in a bench configuration.

With primary reference to FIGS. 19A-19C yet additional features of the support assembly 100' includes the provision of a storage space, area or chamber generally indicated as 60 dimensioned and configured to removably receive and retain a storage container, generally indicated as 104. The storage space 60 is disposed between and the boundaries are at least partially defined by a portion of the elongated leg structure, as at 20" and a correspondingly disposed portion of the base as at 14". As will also be noted in at least FIG. 19C, the storage space or area 60 is located substantially behind the foot extension 30. As such, the storage container 104 is intended to be cooperatively dimensioned and configured to be removably disposed within the storage space 60 and be efficiently and accessibly retained therein. Also, while the storage space or area 60 is represented with the support assembly 100' in the bench configuration 12', the storage space 60 as well as a cooperatively structured storage container 104 may be utilized and accessed when the support assembly 100' is in the chair configuration as represented in at least FIG. 15.

Figures 20, 20A, 20B:
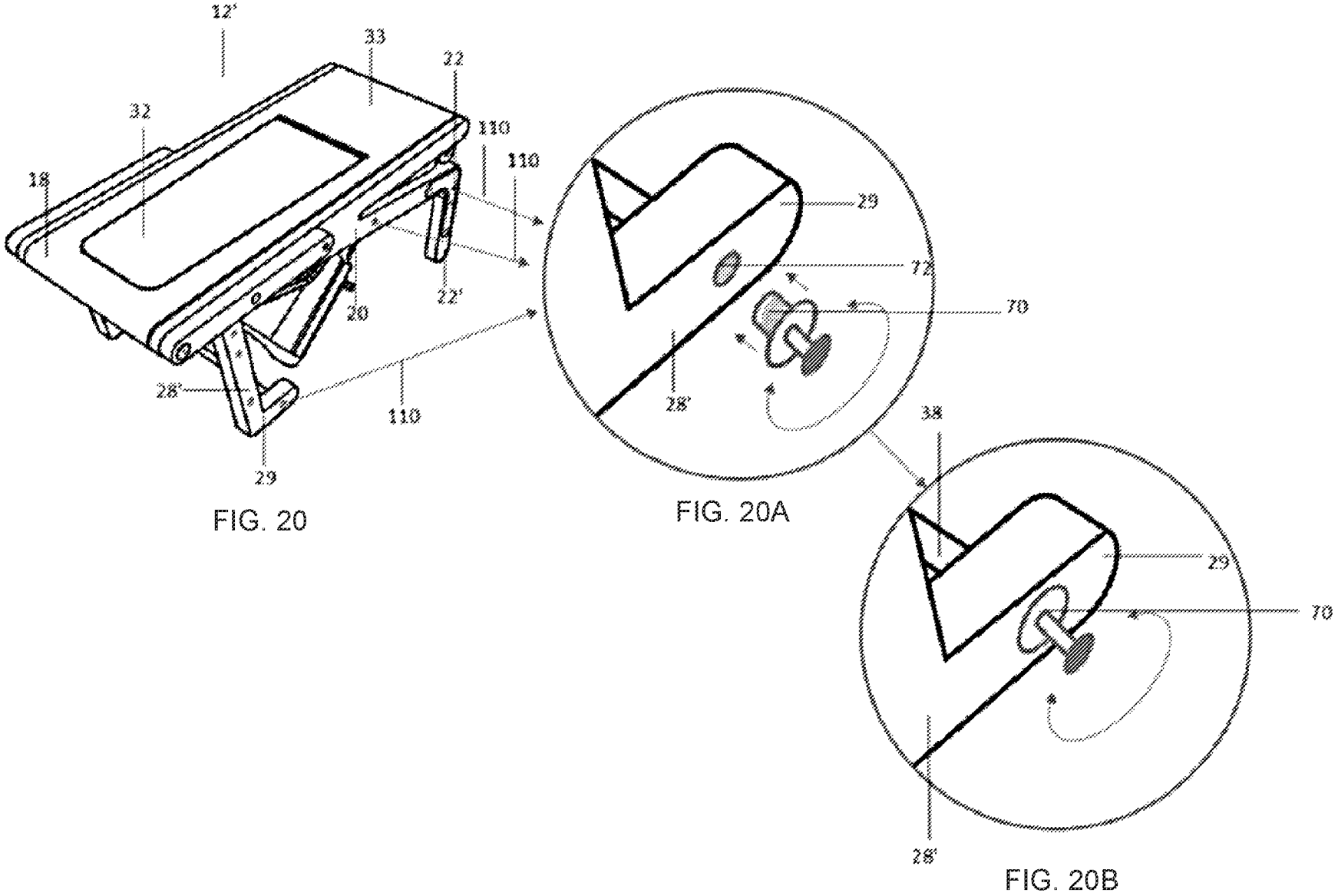
FIG. 20 is a perspective view of the support assembly of the embodiment of FIG. 15 in a bench configuration incorporating a supplemental connector assembly.
FIGS. 20A and 20B are represented detailed views of indicated portions of the embodiment of FIG. 20.
Figure 21:
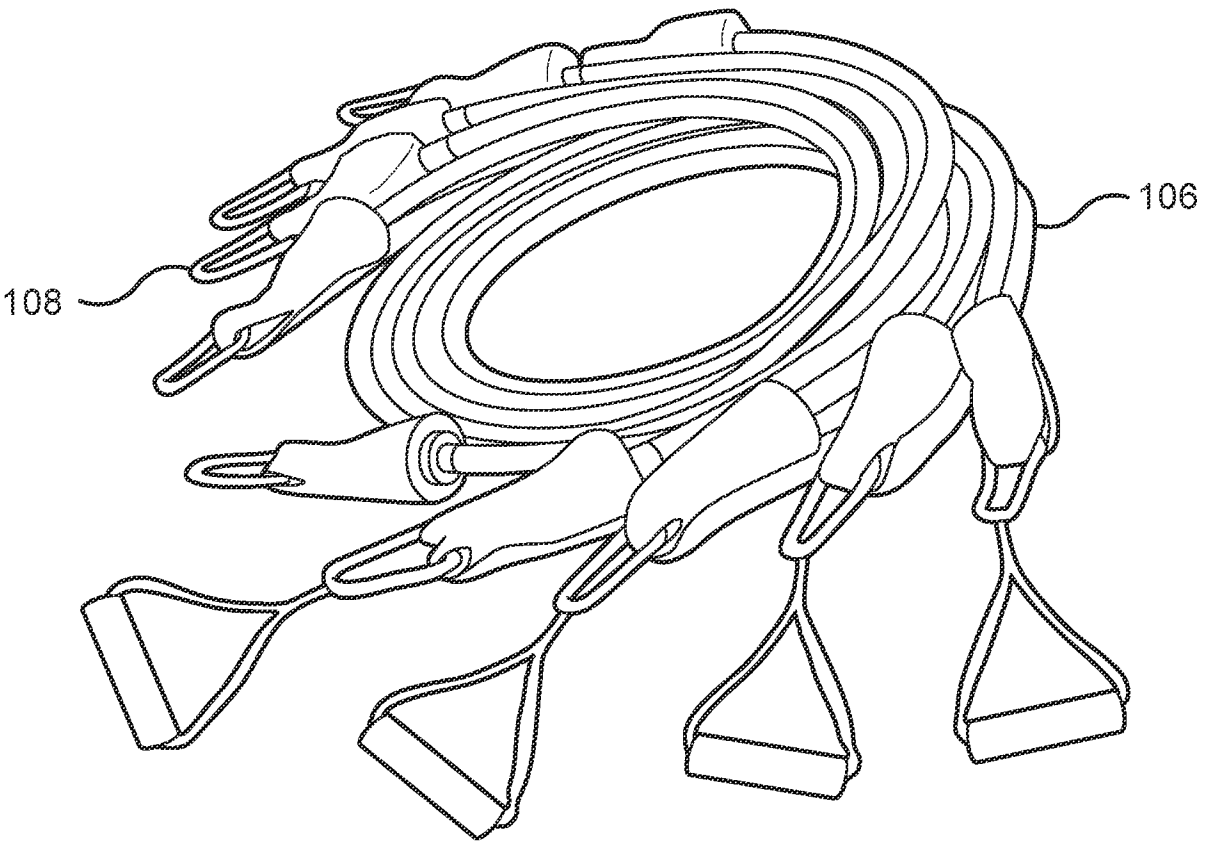
FIG. 21 is a perspective view of a plurality of exercise devises capable of being used with the supplemental connector assembly as represented in FIGS. 20-20B.

With primary reference to FIGS. 20-21, yet another embodiment of the present invention includes the provision of a supplemental connector assembly connected to said base 14 and disposed and structured to removably secure any one of a plurality of different exercise devices in an accessible relation to an occupant of the support assembly 100', at least concurrent to the bench configuration 12'. As represented in FIG. 21, the different types of exercise devices are generally represented as 106 and may be, but are not limited to, resistance bands. As such the one or more resistance bands 106 may include at least one end 108 disposed and configured to removably engage one of a possible plurality of supplemental connectors 70, which individually or collectively define the supplemental connector assembly. As also represented in FIGS. 20-20B, each of the one or more supplemental connectors 70 may be secured to different portions of the base 14 such as, but not limited to, the end 29' of each or either of the armrests 28' of the armrest structure 28. However, as schematically represented by the various arrows 110, each of a plurality of different supplemental connectors 70 may be connected to different portions of the base 14 and or arm rests, 28'. Further, a fixed and/or removable connection of the one or more supplemental connectors 70 may be accomplished by a threaded connection thereof to appropriate openings or like structure(s) 72 formed in the various portions of the base 14 and or armrests 28', as represented.

Figure 22:
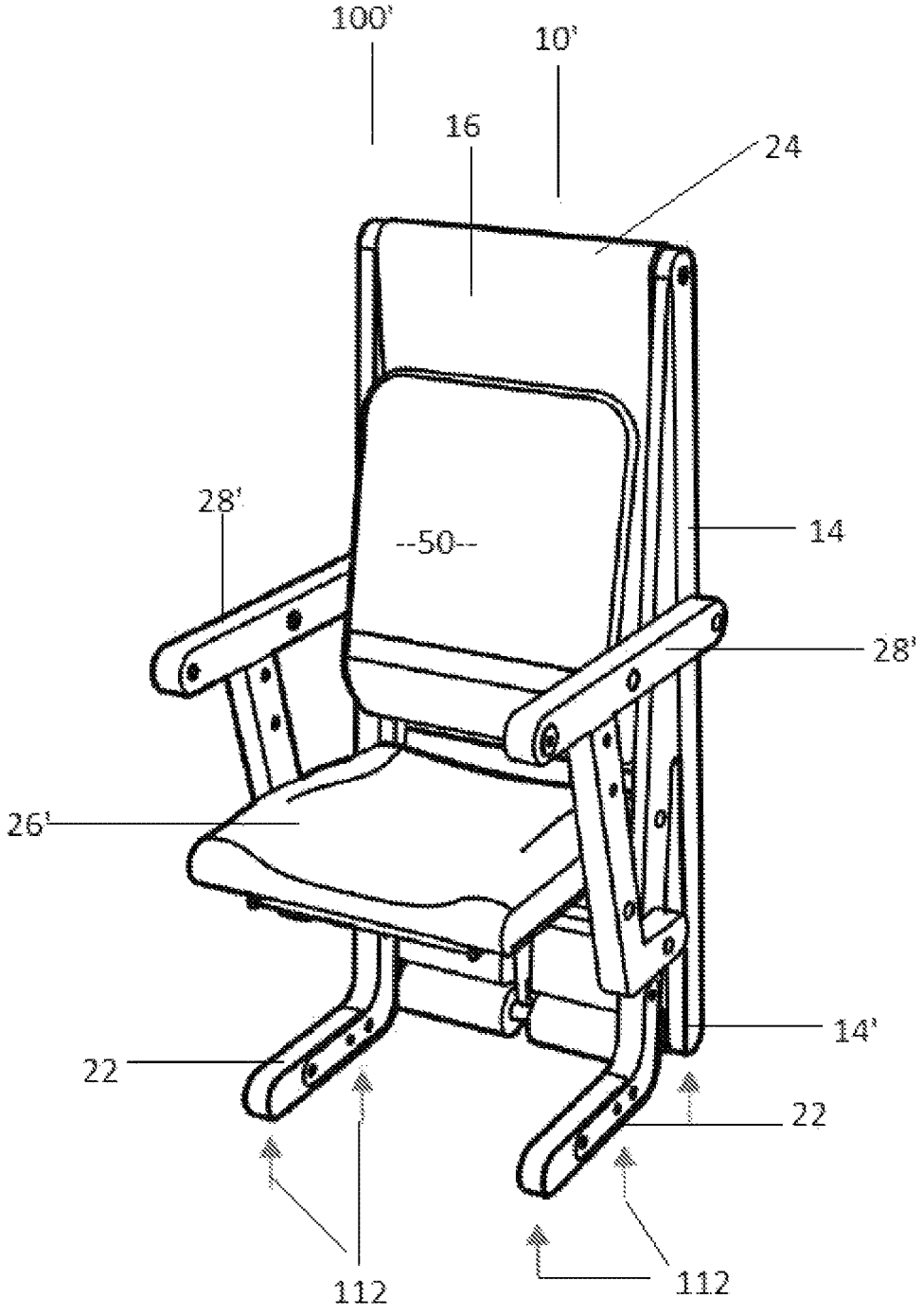
FIG. 22 is a front perspective view of yet another embodiment of the support assembly incorporating formal capabilities.
Figure 23:
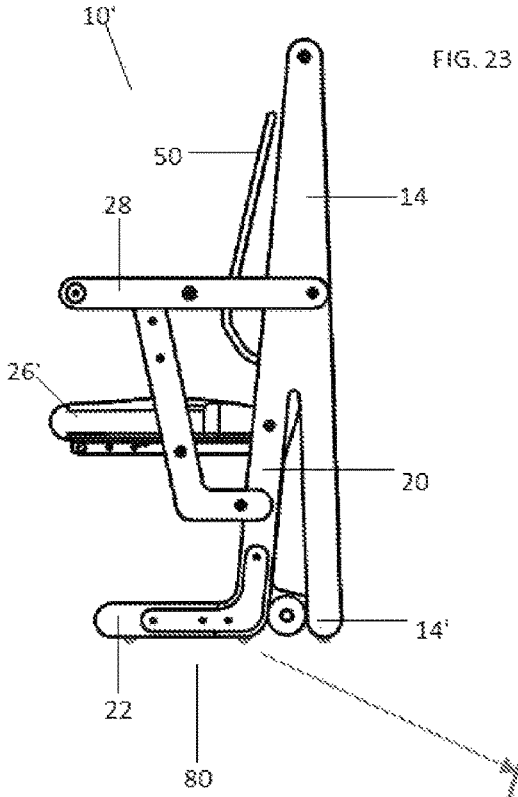
FIG. 23 is a side view the embodiment FIG. 22.
Figure 23A:
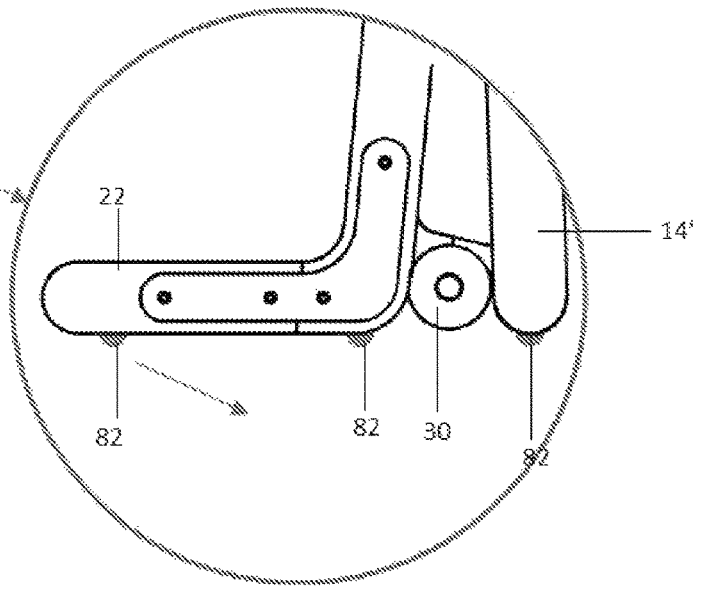
FIG. 23A is a detailed view of indicated portions of the embodiment of FIG. 23.

With primary reference to FIGS. 22-23A, yet another embodiment of the support assembly 100' is directed to the mobility or portability thereof and includes a roller assembly 80. More specifically, the roller assembly 80 includes at least one, but more practically a plurality of rollers 82 disposed on the support assembly 100' such as on the base 14, as at one end 14' and on the outer end of one or both of the legs 20' of the leg structure 20, as schematically represented by arrows 112, in FIG. 22 and/or the detailed view of FIG. 23A. The disposition, structure and operative features of the roller assembly 80, including the one or more rollers 82, which facilitate the movement of the support assembly 100' at least, but not necessarily exclusively, when in the chair configuration 10'. It should be further noted that disposition of one or more rollers 82 can be positioned at other locations, such as along the length of the base 14, to facilitate movement of the support assembly 100' when in the bench configuration 12'.

It is to be noted that the dimensions of each of the support assembly 100 and 100', as represented in detail in FIGS. 1-23, may vary in order to accommodate individuals and/or occupants of various ages and sizes. As such, the dimensions of the various embodiments of the support assembly 100 and 100', when in the chair configuration 10 or 10' or the bench configuration 12 or 12', may vary in order to accommodate children of various ages as well as fully grown adults of both genders. In addition, the material from which the base 14 and/or the various components associated with the support assembly 100 and 100' may include wood, metal and other materials of sufficient strength to accommodate and support an occupant of any age or size, when the support assembly 100 and 100' is in either the chair configuration 10 or 10' or the bench configuration 12 or 12'.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A support assembly convertible into a plurality of different supportive orientations, said support assembly comprising:

an elongated base including an elongated leg structure and comprising a front segment and a rear segment disposed on opposite sides of said base, said base disposable in a first supportive orientation comprising said front segment disposable in a chair configuration, said chair configuration comprising a backrest, a seat and an armrest structure, said seat and said armrest structure movable relative to one another and adjustably disposed relative to said backrest, of said chair configuration, a second supportive orientation comprising said rear segment disposed in a bench configuration, and said bench configuration comprising said elongated leg structure and said armrest structure concurrently disposed in engaging relation to a supporting surface of said bench configuration.

2. The support assembly as recited in claim 1 wherein said seat is adjustably disposed along the length of said backrest at different heights relative to the supporting surface.

3. The support assembly as recited in claim 2 wherein said armrest structure is adjustably disposed along a length of said base relative to the supporting surface.

4. The support assembly as recited in claim 2 further comprising a support segment disposed on said backrest in supportive engagement with a back portion of an occupant of said chair configuration.

5. The support assembly as recited in claim 1 further comprising a support segment adjustably disposed on said backrest in supportive engagement with a back portion of an occupant of said chair configuration.

6. The support assembly as recited in claim 1 wherein said armrest structure is adjustably disposed along a length of said base relative to the supporting surface.

7. The support assembly as recited in claim 1 wherein said elongated leg structure includes one end extending transversely outward from a remainder of said elongated leg structure, said bench configuration further comprising an outer extremity of said one end and a majority of a length of said armrest structure concurrently disposed in engaging relation to the supporting surface.

8. The support assembly as recited in claim 1 wherein said bench configuration comprises said rear segment disposed in an outwardly exposed substantially reclined position; said rear segment further comprising a back support movably connected to said base and alternatively disposable in a collapsed position and in an outwardly extended position.

9. The support assembly as recited in claim 1 wherein said base includes a roller assembly, said roller assembly disposed on said elongated leg structure and concurrently in movable engagement with the supporting surface at least concurrent to said chair configuration.

10. The support assembly as recited in claim 1 further comprising a supplemental connector assembly connected to said base and disposed and structured to removably secure an exercise device in accessible relation to an occupant, at least concurrent to said bench configuration.

11. The support assembly as recited in claim 10 wherein said supplemental connector assembly comprises a plurality of connector members removably attached to said base in spaced relation to one another, said plurality of connector members being cooperatively disposed to removably secure a plurality of exercise devices in accessible relation to an occupant, at least concurrent to said bench configuration.

12. The support assembly as recited in claim 1 further comprising a storage space disposed between said the elongated leg structure and a correspondingly disposed portion of said base; said storage space cooperatively dimensioned and configured to removably retain at least one storage container therein.

13. A support assembly convertible into a plurality of different supportive orientations, said support assembly comprising:

an elongated base including an elongated leg structure and comprising a front segment and a rear segment disposed on opposite sides of said base, said base disposable in a first supportive orientation comprising said front segment disposable in a chair configuration, said chair configuration comprising a backrest, a seat and an armrest structure, said chair configuration further comprising said backrest, said seat and said armrest structure movably and collectively connected to one another to define a substantially upright adjustably variable orientation of said chair configuration on a supporting surface, a second supportive orientation comprising said rear segment disposed in a bench configuration; said bench configuration comprising said rear segment disposable in an outwardly exposed reclined position, and said reclined position further comprising said rear segment including a back support disposable in an outwardly extended, substantially transverse relation to said base.

14. The support assembly as recited in claim 13 wherein said seat and said armrest structure are each adjustably disposed along the length of said backrest at respectively different heights relative to the supporting surface.

15. The support assembly as recited in claim 13 further comprising a support segment disposed on said backrest in supportive engagement with a back portion of an occupant of said chair configuration.

16. The support assembly as recited in claim 13 wherein said reclined position further comprising said back support disposable in a substantially angularly inclined orientation.

17. The support assembly as recited in claim 13, wherein said bench configuration further comprises an outer end of said elongated leg structure and a majority of a length of said arm rest structure concurrently engaging the supporting surface in supporting relation to said base.

18. The support assembly as recited in claim 13 wherein said base includes a roller assembly, said roller assembly disposed to movably engage the supporting surface at least concurrent to said chair configuration.

19. The support assembly as recited in claim 13 further comprising a supplemental connector assembly connected to said base and disposed and structured to removably secure an exercise device in accessible relation to an occupant, at least concurrent to said bench configuration.

20. The support assembly as recited in claim 13 further comprising a storage space disposed between said elongated leg structure and a correspondingly disposed portion of said base; said storage space cooperatively dimensioned and configured to removably retain at least one storage container therein.

* * * * *